United States Patent [19]

Svensson

[11] Patent Number: 4,624,453

[45] Date of Patent: Nov. 25, 1986

[54] DOCUMENT COUNTER

[75] Inventor: Lennart Svensson, Malmö, Sweden

[73] Assignee: Scan Coil AB, Malmö, Sweden

[21] Appl. No.: 719,421

[22] Filed: Apr. 3, 1985

[30] Foreign Application Priority Data

Apr. 4, 1984 [SE] Sweden ..... 8401862

[51] Int. Cl.[4] ..... B65H 5/02

[52] U.S. Cl. ..... 271/4; 271/10; 271/35; 271/187; 271/270; 271/202; 271/315

[58] Field of Search ..... 271/4, 35, 160, 167, 271/187, 315, 273, 274, 10, 270, 202

[56] References Cited

U.S. PATENT DOCUMENTS

| | | | |
|---|---|---|---|
| 707,220 | 8/1902 | Eylar | 271/35 |
| 2,852,255 | 9/1958 | Fischer . | |
| 3,409,290 | 11/1968 | Bergland | 271/187 X |
| 3,612,512 | 10/1971 | Lang | 271/35 |
| 3,912,255 | 10/1975 | McInerny . | |
| 4,054,092 | 10/1977 | Loftus | 271/35 X |
| 4,128,236 | 12/1978 | Lundblad | 271/35 X |
| 4,474,365 | 10/1984 | DiBlasio | 271/315 X |

FOREIGN PATENT DOCUMENTS 1162011 8/1969 United Kingdom .

*Primary Examiner*—Richard A. Schacher

*Attorney, Agent, or Firm*—Merchant, Gould, Smith, Edell, Welter & Schmidt

[57] ABSTRACT

Document counter with discharge means comprising a support for a wad of documents, an endless conveyor belt which can be moved about a rotational axis, means for guiding the conveyor belt in the plane of the support to engage the lowermost document on the support, and collecting means comprising a flap wheel system which can be rotated about a rotational axis which is parallel to the rotational axis of the conveyor belt, flaps extending from the periphery of the flap wheel system, said flaps forming pockets mutually spaced circumferentially, which open in a direction opposite to the rotational direction of the flap wheel system, and a receptacle located at the moving path of the flaps for receiving the documents from the pockets of the flap wheel system. The discharge means and the collecting means are positioned adjacent each other with a holder gap positioned substantially on the circumference of the flap wheel system, and the rotational speed of the flap wheel system of the collecting means is lower than the rotational speed of the conveyor belt of the discharge means.

7 Claims, 7 Drawing Figures

DOCUMENT COUNTER

The present invention relates to a document counter for discharging the documents of a wad of documents one at a time from the lower end of the wad.

It is the purpose of the invention to provide a document counter of this kind, which operates in a reliable manner at high speed, generates low noise and is of a light and compact construction, and which is also easy to use and maintain.

For this and other purposes which will be apparent from the description which follows, the invention provides a document counter comprising discharging means having a support for a wad of documents, an endless conveyor belt moving about an axis of rotation, and means for guiding the conveyor belt in the plane of the support into contact with the lowermost document on the support; collecting means having a flap wheel system rotating about an axis of rotation which is parallel to the axis of rotation of the conveyor belt, flaps extending from the periphery of the flap wheel system and forming pockets mutually spaced along the periphery, said pockets opening in a direction which is opposite to the rotational direction of the flap wheel system, the discharge means and the collecting means being located adjacent each other to form a holder tap positioned substantially on the circumference of the flap wheel system, and a receptacle for receiving the documents from the pockets of the flap wheel system; and means for driving said flap wheel system and said conveyor belt, the rotational speed of the flap wheel system of the collecting means being lower than the rotational speed of the conveyor belt of the discharge means.

Figure 1:
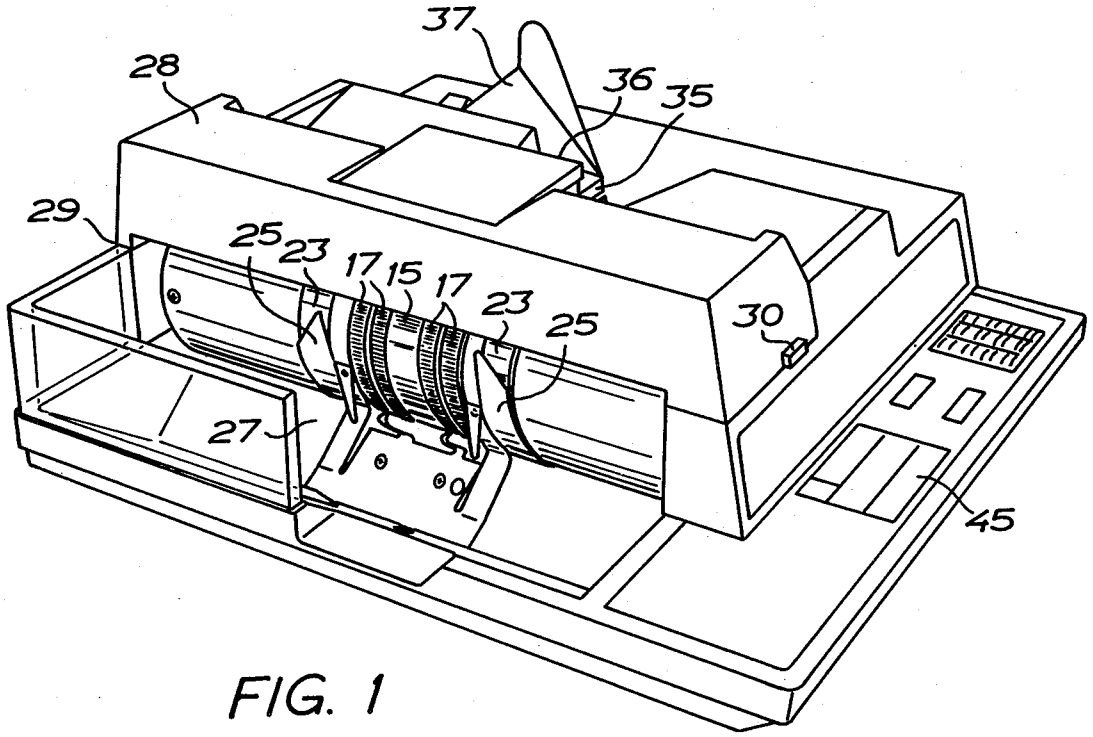
Figure 2:
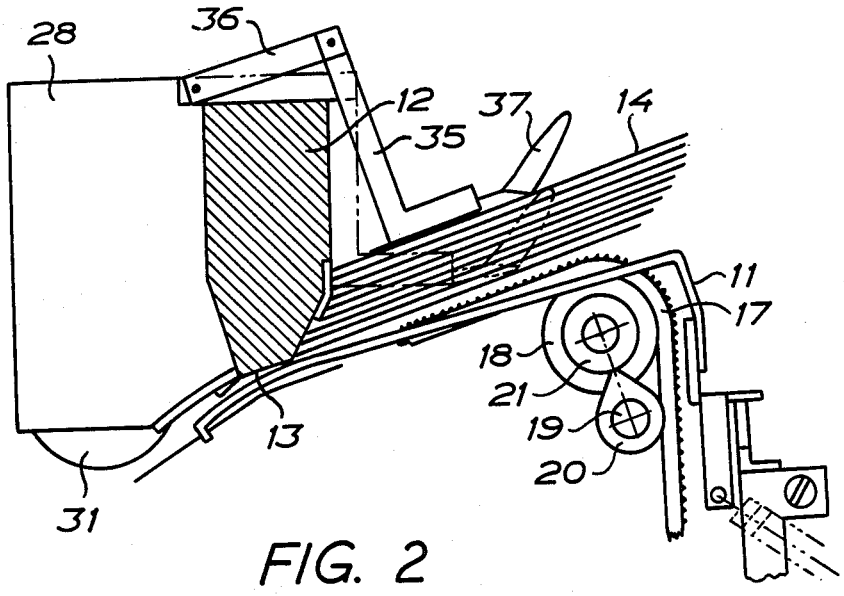
Figure 3:
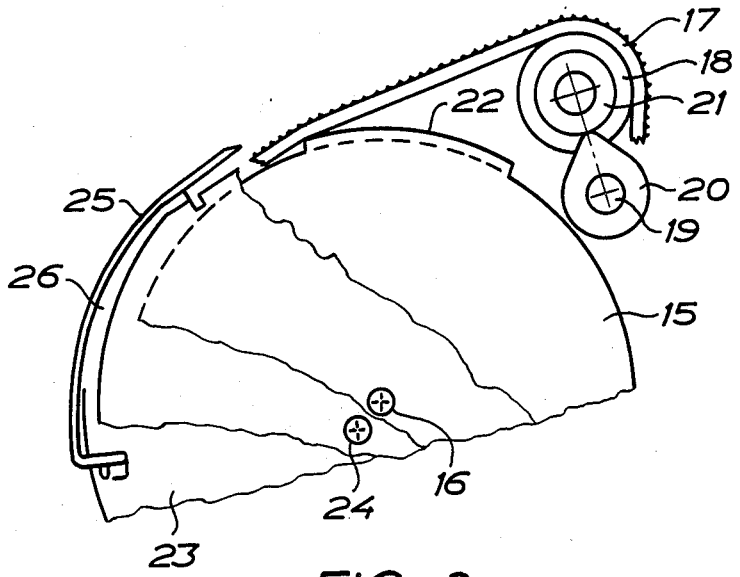
Figure 4:
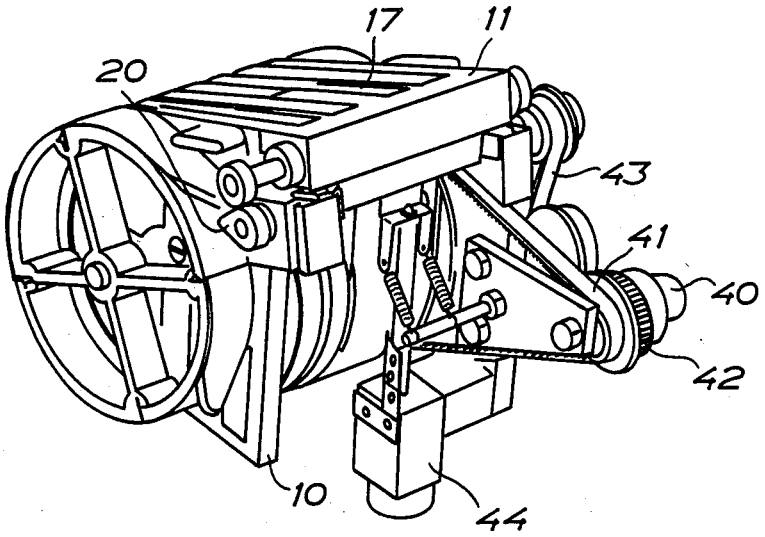
Figure 5:
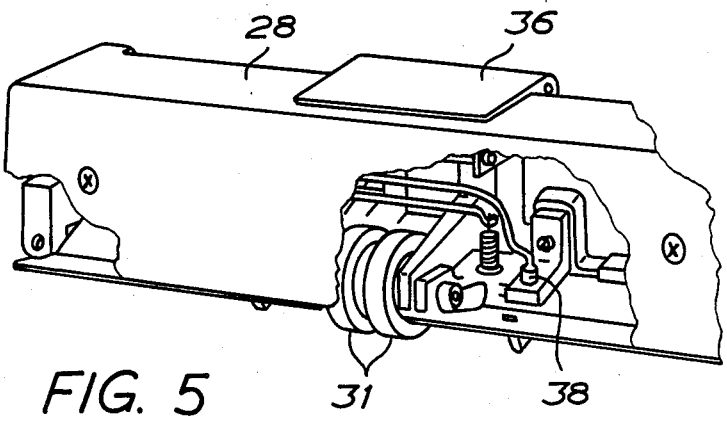
Figure 6:
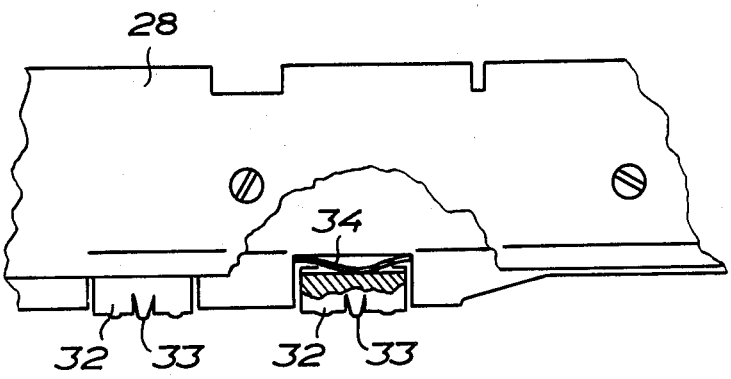
Figure 7:
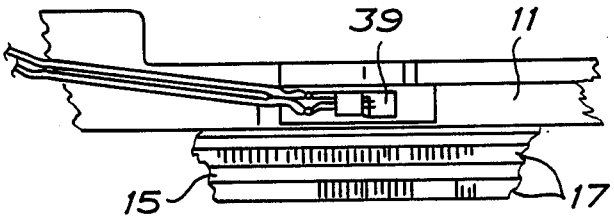

In order to illustrate the invention an embodiment thereof will be described in more detail below, reference being made to the accompanying drawings in which FIG. 1 is a perspective view of the document counter of the invention in one embodiment thereof, FIG. 2 is a diagrammatic side view of the discharge means, FIG. 3 is a diagrammatic side view of the collecting means, FIG. 4 is a perspective view of the frame of the document counter and elements mounted thereon, FIG. 5 is a fragmentary perspective view with parts thereof broken away, of a bar forming part of the document counter, FIG. 6 is a fragmentary front view of the bar in FIG. 5 also with parts thereof broken away, and FIG. 7 is a fragmentary plan view of a sensor forming part of the document counter.

The document counter comprises a frame 10 which is shown in FIG. 4 of the drawings. A support 11 formed substantially as a plate, is mounted at the remote end thereof as seen in FIG. 4 on the frame by means of a shaft (not shown) such that the support is inclined downwards towards a transverse holder beam 12 the lower edge of which forms a holder gap 13 together with the support (FIG 2). The holder gap comprises a slot through which the documents 14 of a wad of documents located on the support, are to be fed one at a time.

A feeder cylinder 15, FIG. 3, is rotatably mounted to the frame by means of a horizontal rotational shaft 16. The periphery of the feeder cylinder has four guide grooves equally spaced, four conveyor belts 17 extending around a horizontal lift wheel system 18 which is mounted to the frame 10 for displacement in the vertical direction. At the lower side of the lift wheel system, a cam shaft 19 is rotatably mounted to the frame, said shaft being provided with cam wheels 20 contacting lift wheels 21 forming part of the lift wheel system. The feeder cylinder forms two diametrically opposite cams 22 for each guide groove therein, FIG. 3, which extend from the bottom of the guide groove to the surface of the feeder cylinder such that the conveyor belts are guided on the periphery of the feeder cylinder at the cams but are located in the guide grooves at other positions.

At the opposite ends of the feeder cylinder, two flap wheels 23 are located which are rotatably mounted to the frame by means of a horizontal shaft 24. The diameter of the flap wheels is substantially as large as the diameter of the feeder cylinder, but the rotational shaft 16 and the rotational shaft 24 are located eccentrically in relation to each other such that the flap wheel always extends beyond the periphery of the feeder cylinder to the region of the later half of the holder gap. Each flap wheel is provided with four flaps 25 equally spaced circumferentially. Together with the periphery of the flap wheel, the flaps form four pockets 26 opening in a direction which is opposite to the rotational direction. A receptacle 27 is located adjacent the moving path of the flaps, FIG. 1.

The holder beam 12 is supported by a bar 28 which is pivotally mounted to the document counter at 29 at one end thereof and can be latched in the position shown in FIG. 1 by means of a latch mechanism. This mechanism is operated by means of a push button 30 to make possible that the bar 28 is swung from the position shown in order to uncover the mechanism of the document counter for inspection and service, but above all in order to make possible that the path for the documents is checked for any document having got stuck in the document path. Two wheels 31 are rotatably mounted in the bar 28 to engage the periphery of the feeder cylinder 15. Two sliding elements 32 e.g. of plastic material, are mounted to the lower side of the bar 28, each element having a tongue 33 projecting in a direction opposite to the feeding direction of the documents through the document counter. These sliding elements are slightly biased by means of springs 34 to engage the conveyor belts 17 while the tongues 33 are located in the space between the conveyor belts.

On the bar 28 there is also mounted an angular pressure foot 35 pivotally connected to the bar by means of a link 36. This pressure foot engages the documents 14 resting on the support 11 and will take a lifted and inclined position in dependence on the thickness of the wad of documents. At the outer end thereof, the pressure foot has a guide rail 37 allowing a wad of documents to be inserted under the pressure foot 35 without the necessity of lifting the pressure foot, since this foot is automatically raised when the wad of documents is inserted under the guide rail 37, the outer end portion of which projecting upwards, slides onto the wad of documents while the pressure foot is being lifted.

In the bar 28, a light source such as a LED 38 is provided, which is directed downwards towards the support 11 in which a photocell 39 is provided opposite to the LED 38. These two elements the function of which will be explained closer below, are easily available for cleaning and other service due to the possibility of swinging the bar 28 upwards from the horizontal operative position thereof.

An electric drive motor (not shown) rotates a shaft 40, FIG. 4, which is rotatably mounted in the frame and in turn rotates the feeder cylinder 15 over a belt 41, the flap wheels 23 over a belt 42, and the cam wheels 20 over a belt 43. In this connection, the ratio is chosen such that the rpm of the feeder cylinder is twice as large as the rpm of the flap wheels, and the rpm of the cam wheels is twice as large as the rpm of the feeder cylinder.

The rear end of the support is connected to an electromagnet 44 mounted to the frame by means of which the support can be lifted to an idle position wherein the support is located above the level for the conveyor belts lifted by the cam wheels, and can be lowered to a grip position wherein the support is located below the level of the lifted conveyor belts but above the level of the lowered conveyor belts.

The feeder device operates in the following manner:

The rotating elements of the feeder device are synchronized such that the cam wheels 20 have rotated to a position in which they lift the conveyor belts to an elevated gripping position above the level of the support slightly before the cams 22 of the feeder cylinder at the leading ends thereof having been rotated to a position at the holder gap 13. At that moment, the trailing ends of the flaps 25 of the flap wheel system have just passed the holder gap. FIG. 3 illustrates this situation. The conveyor belt engages the lowermost document of the wad of documents and pushes said document towards the holder gap so that the conveyor belts, when the cams of the feeder cylinder are rotated to a position at the holder gap, are pressured against the lower side of the document over the entire width thereof. Due to the gap between the document and the conveyor belts the document will slide under the wad of documents together with the conveyor belts to the holder gap, the holder beam simultaneously preventing the rest of the documents from moving from the site. When the document has arrived at the holder gap and the cams of the feeder cylinder have pressed the conveyor belts to a firm engagement with the document, the cam wheels 20 will immediately rotate to a position in which the lift wheel system with the conveyor belts moves below the level of the support so that the conveyor belts do not touch the document next to the lowermost document in the wad.

The conveyor belts forward the lowermost document through the holder gap and push the document between the periphery of the feeder cylinder 15 and the periphery of the wheels 31 so that the circumferential surface of the feeder cylinder takes care of the advancement of the document after the cams of the feeder cylinder having passed the holder gap and lower the conveyor belts into the guide grooves. When the document passes through the holder gap, the insertion of the document into a pocket 26 formed by the flaps 25 of the flap wheel system, will be initiated. Due to the fact that the feeder cylinder is rotated at double the speed in relation to the flap wheel system, the document will be inserted into the pocket of the flap wheel system at a speed which is higher than the forward speed of the pocket so that the document will reach the bottom of the pocket before the pocket has been rotated to a position at the receptacle 27. When the document reaches the bottom of the pocket, it has disengaged the wheels 31 so that the flap wheel system retards the advancement of the document and transfers the retarded document to the receptacle. When this happens, the elements of the feeder device have again been rotated to a new gripping position, which means that the cam wheels 20 have been rotated one revolution to the lifting position, the feeder cylinder 15 has been rotated half a revolution to the gripping position, and the flap wheels 23 have been rotated a quarter of a revolution to the receiving position to feed a following document from the wad of documents.

If it is desired to feed by means of the feeder device a specific number of documents, order is given to the electromagnet 44 in a manner known per se to lift the support 11 to the idle position when the desired number has been fed from the wad of documents so that the conveyor belts do not engage the documents and the support closes the holder gap. The order to the electromagnet 44 can be given from an operator's console 45 including an electronic system with the proper program software for counting the documents. The sensor system mentioned above and including the LED 38 and the photocell 39 should be connected to the electronic system of the console, and the purpose thereof is to sense the width of a document passing through the document counter. Then, the sensed width of the first document is stored in the electronic system and the width measured of all following documents is compared with the width of the document which first passed through the document counter. By this comparison, the operation of the apparatus is stopped by means of the electronic system as soon as a deviation of the measured width from the width of the document which first passed through the document counter, is indicated.

The electronic system with the associated program software has not been described in more detail here, since at the present state of the art the skilled man will encounter no difficulties in constructing proper electronic circuits for performing the function described.

The tongues 33 are directed towards the moving direction of the documents below the holder beam 12 and the purpose thereof is to stop the document next to the last document, should it tend to accompany the lowermost document at withdrawal thereof from the wad of documents.

I claim:

1. Document counter comprising discharge means having a support for a wad of documents, collecting means having a flap wheel system rotating about an axis of rotation, the discharge means and the collecting means being located adjacent each other to form a holder gap positioned substantially on the circumference of the flap wheel system, flaps extending from the periphery of the flap wheel system and forming pockets mutually spaced along the periphery, said pockets opening in a direction which is opposite to the rotational direction of the flap wheel system, a feeder cylinder rotating about an axis of rotation which is located inside the circumference of the flap wheel system, at least one endless conveyor belt passed around the feeder cylinder, means for guiding the conveyor belt in the plane of the support, at least one cam on the feeder cylinder for pressing the conveyor belt into the holder gap and into engagement with the lowermost documents on the support, a receptacle for receiving the documents from the pockets of the flap wheel system, and means for driving said flap wheel system and said conveyor belt, the rotational speed of the flap wheel system being lower than the rotational speed of the conveyor belt.

2. Document counter as claimed in claim 1 further comprising a beam defining the holder gap and a bar mounting said beam, which can be swung from an operative position in parallel with the rotational axis of the conveyor belt, to a raised position for uncovering the path for advancing the documents.

3. Document counter as claimed in claim 2 further comprising a pressure foot pivoted to the bar for pressing a wad of documents against the support.

4. Document counter as claimed in claim 3 further comprising a guide rail mounted to the pressure foot for lifting the pressure foot by engaging a wad of documents with the guide rail.

5. Document counter as claimed in claim 1 wherein the rotational speed of the conveyor belt is twice the rotational speed of the flap wheel system.

6. Document counter as claimed in claim 1 further comprising a lift wheel system, said conveyor belt passing around the lift wheel system, lift means operatively connected with the lift wheel system for moving said system between a raised gripping position in which the conveyor belt is at the same level as the support to engage the lowermost document on the support, and a lowered disengaged position in which the lift wheel system is brought into gripping position when the cam of the feeder cylinder pressures the conveyor belt into the holder gap.

7. Document counter as claimed in claim 6 wherein the support is mounted for pivoting vertically and further comprising lift means operatively connected to the support for pivoting the support to a raised idle position in which the plane of the support is positioned above said engaged position of the conveyor belt.

* * * * *